US011075479B2

(12) United States Patent
Bhagyanathan Sathianathan et al.

(10) Patent No.: US 11,075,479 B2
(45) **Date of Patent: *Jul. 27, 2021**

(54) TERMINAL FITTING

(71) Applicant: Molex, LLC, Lisle, IL (US)

(72) Inventors: Dwaraganathan Bhagyanathan Sathianathan, Rochester Hills, MI (US); Yves LePottier, Ann Arbor, MI (US)

(73) Assignee: Molex, LLC, Lisle, IL (US)

( * ) Notice: Subject to any disclaimer, the term of this patent is extended or adjusted under 35 U.S.C. 154(b) by 549 days.

This patent is subject to a terminal disclaimer.

(21) Appl. No.: 16/074,261

(22) PCT Filed: Feb. 7, 2017

(86) PCT No.: PCT/US2017/016788

§ 371 (c)(1),
(2) Date: Jul. 31, 2018

(87) PCT Pub. No.: WO2017/139249

PCT Pub. Date: Aug. 17, 2017

(65) Prior Publication Data

US 2021/0184382 A1 Jun. 17, 2021

Related U.S. Application Data

(60) Provisional application No. 62/292,453, filed on Feb. 8, 2016.

(51) Int. Cl.
*H01R 13/11* (2006.01)
*H01R 4/18* (2006.01)
(Continued)

(52) U.S. Cl.
CPC ..... *H01R 13/11* (2013.01); *H01R 4/185* (2013.01); *H01R 13/03* (2013.01); *H01R 13/18* (2013.01); *H01R 13/432* (2013.01)

(58) Field of Classification Search
CPC ..... H01R 13/15; H01R 13/18
See application file for complete search history.

(56) References Cited

U.S. PATENT DOCUMENTS 4,838,816 A 6/1989 Matsusaka et al.
7,351,122 B2 4/2008 Suemitsu et al.
(Continued)

FOREIGN PATENT DOCUMENTS

JP S60-110930 U 7/1985
JP 2006-286223 A 10/2006
(Continued)

OTHER PUBLICATIONS

Notification of Reasons for Refusal received for Japanese Patent application No. 2018-540159, dated Sep. 17, 2019, 8 pages. (4 pages of English translation and 4 pages of official copy).
(Continued)

*Primary Examiner* — Ross N Gushi

(57) ABSTRACT

An electrical terminal fitting includes a body and a covering. The body is formed from a first material and includes a connection section and a contacting section with the contacting section having a flexible contact beam and an opposing stationary beam for receiving a male pin of a mating terminal. The covering is formed from a second material having a higher tensile strength than the first material and is secured to the body. The covering includes a stiffening beam and a support beam that are spaced apart from the flexible contact beam that provide increased normal force to the flexible contact beam upon engagement of the flexible contact beam with the stiffening beam.

16 Claims, 16 Drawing Sheets

(51) Int. Cl.

| | |
|---|---|
| ***H01R 13/03*** | (2006.01) |
| ***H01R 13/432*** | (2006.01) |
| ***H01R 13/18*** | (2006.01) |

(56) References Cited

U.S. PATENT DOCUMENTS

| | | | | |
|---|---|---|---|---|
| 10,122,108 | B2 * | 11/2018 | Bhagyanathan Sathianathan ..... | H01R 13/432 |
| 2012/0244756 | A1 | 9/2012 | Jouas et al. | |
| 2017/0047677 | A1 | 2/2017 | Bhagyanathan Sathianathan et al. | |

FOREIGN PATENT DOCUMENTS

| | | | | | |
|---|---|---|---|---|---|
| JP | 2011-049107 | A | | 3/2011 | |
| WO | WO-2015164754 | A1 | * | 10/2015 | ..... H01R 13/432 |
| WO | 2017/139249 | A1 | | 8/2017 | |

OTHER PUBLICATIONS

International Search Report and Written Opinion received for PCT application No. PCT/US2017/016788, dated May 12, 2017, 10 pages.

International Preliminary Report on Patentability received for PCT Application No. PCT/US2017/016788, dated Aug. 23, 2018, 9 pages.

* cited by examiner

TERMINAL FITTING

RELATED APPLICATIONS

This application is a national stage of International Application No. PCT/US2017/016788, filed Feb. 7, 2017, which claims priority to U.S. Provisional Application No. 62/292,453, filed on Feb. 8, 2016, both of which are incorporated herein by reference in their entirety.

FIELD OF THE INVENTION

The disclosure relates to field of Electrical Terminal Fittings.

DESCRIPTION OF RELATED ART

The disclosure generally relates to an electrical terminal contact and, more specifically, to an electrical terminal contact for a connector system that can be used in a vehicle. In general, connectors of this type are suitable for use in vehicle systems including junction distribution blocks, power control modules and other body control systems. These systems typically employ a wire harness to connect the various body and control systems throughout the vehicle.

BRIEF SUMMARY

A connector system is provided that includes a plug connector and a receptacle connector. The connector system typically includes a plug connector assembly or header assembly including a plurality of electrical conducting terminals that are coupled to a printed circuit board and a receptacle connector assembly including a corresponding number of mating electrical terminals coupled to a wiring harness. In alternative arrangements, a plug and receptacle system may both be coupled to respective ends of a wire harness. These arrangements are typically known as wire to board and wire to wire connection systems.

These connector systems includes a header or plug connector having a plurality of male electrical terminals or pins either mounted on a printed circuit board or retained in a plug or first insulative housing. A receptacle connector includes a molded exterior housing with a plurality of pockets or cavities to retain a plurality of female terminals for cooperatively mating with the first plug connector housing. Each of the respective connector assemblies include an electrical terminal fitting having a locking or retaining arm extending from the terminal and an insulative housing including a cavity with integrally molded structure engaging the retaining arm to fully retain and lock the corresponding electrical terminals on the housing.

With increased demand for smaller terminals and increased performance, the female electrical terminal in an embodiment is constructed from two separate pieces, a contacting or electrical piece and a reinforcing piece or support piece. The contacting piece made from a highly conductive metal allowing for superior electrical performance and the support piece made from a high strength material to provide superior retention force and contacting beam reinforcement.

BRIEF DESCRIPTION OF THE DRAWINGS

The disclosure is illustrated by way of example, and not limited, in the accompanying figures in which like reference numerals indicate similar elements and in which.

DETAILED DESCRIPTION

As required, detailed embodiments of the disclosure are presented herein; however, and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the disclosure. It is to be understood that the disclosed embodiments are merely exemplary of the disclosure, which may be embodied in various forms.

The connector system includes a first connector generally mounted to a printed circuit board or at an end of a vehicle wire harness and a second connector or receptacle 10 disposed on a second end of a vehicle wiring harness (not shown). The first end of the wire harness includes a first connector having a housing formed from an insulative material for mating with a corresponding connector or receptacle. The disclosure that follows is directed to the receptacle portion of the connector assembly in particular to the electric terminal 10 associate with the receptacle. The terminal 10 is of the female type for receiving a male pin (not shown).

Figure 1:
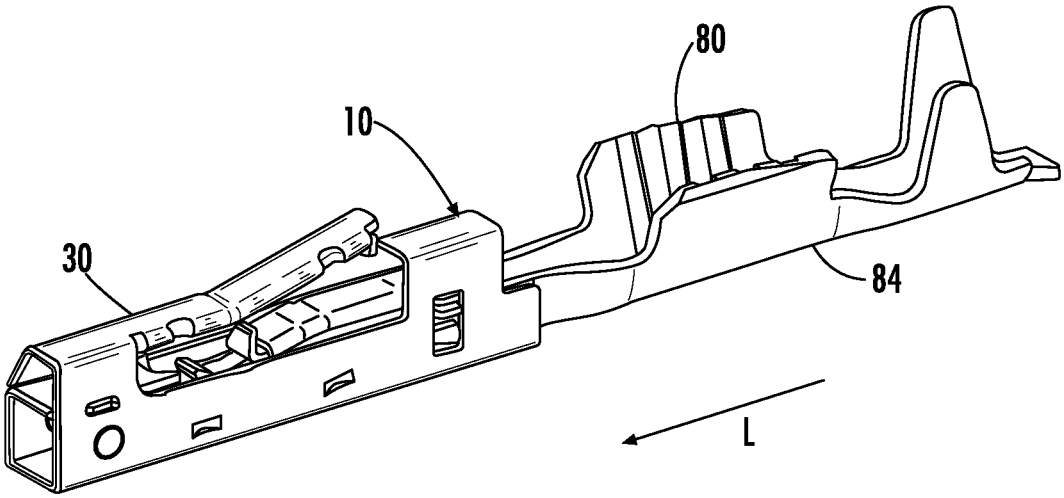
FIG. 1 is a perspective view of the terminal according to the disclosure.
Figure 2:
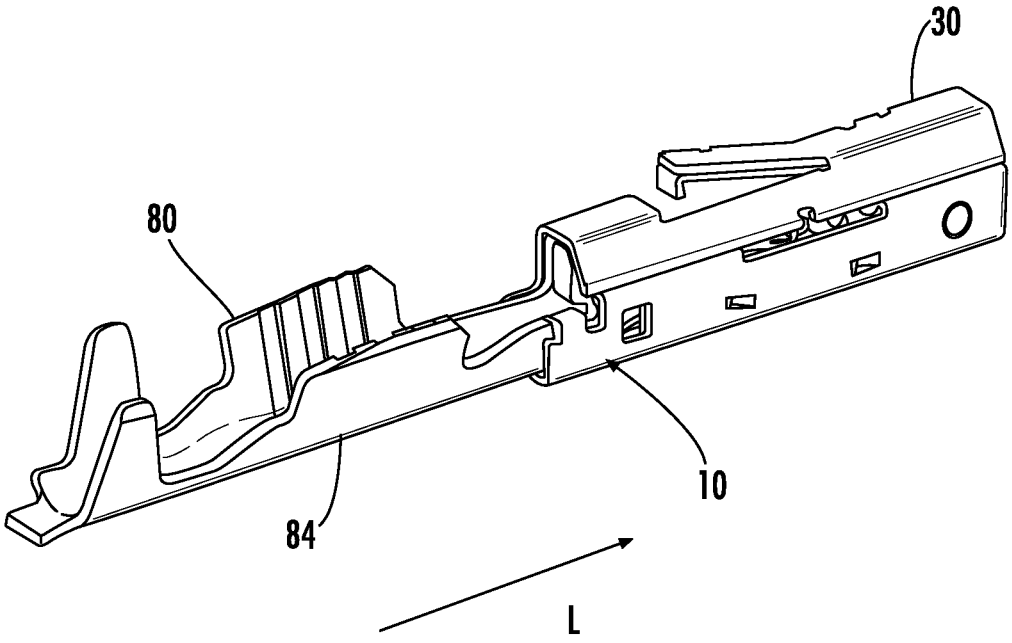
FIG. 2 is an alternative perspective of the terminal of FIG. 1.
Figure 3:
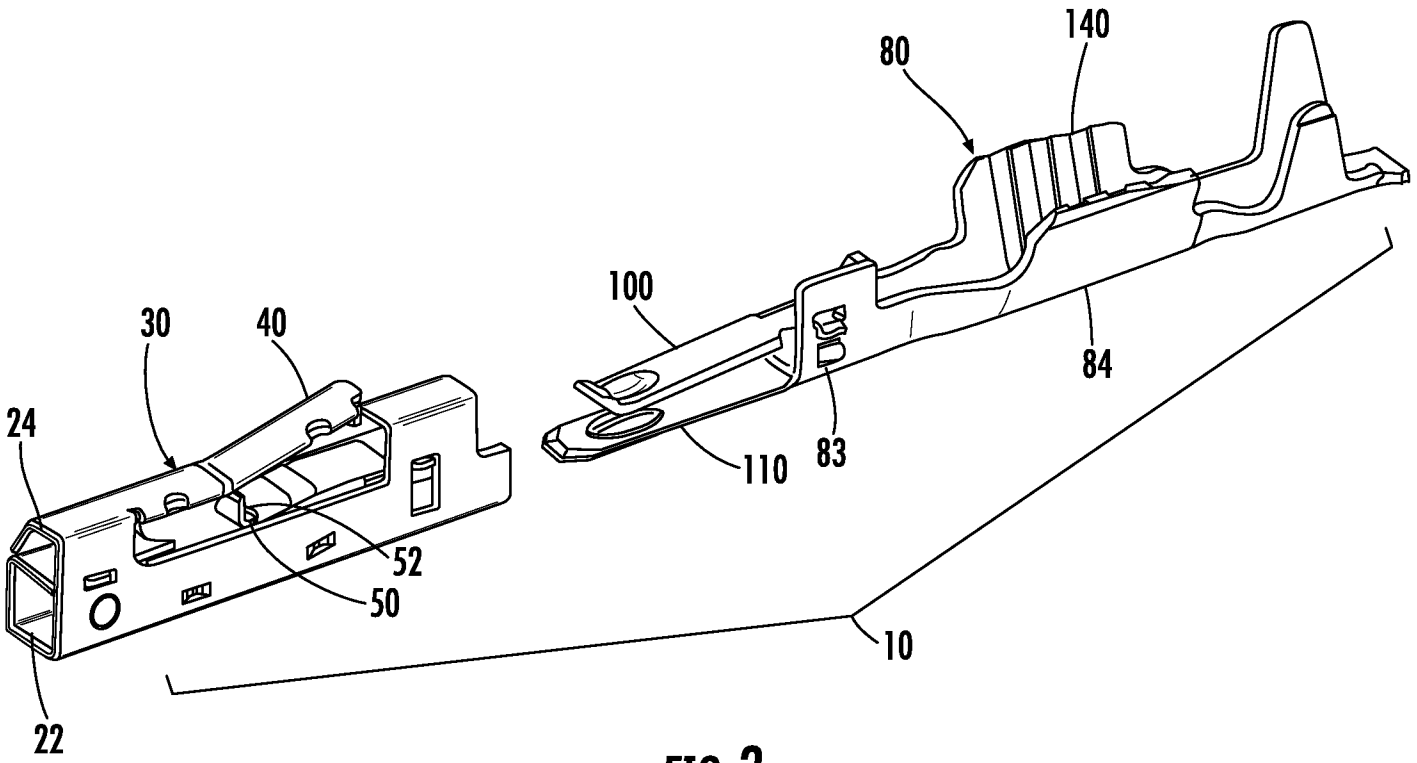
FIG. 3 is an exploded view of the terminal according to FIG. 1.

As shown in the FIGS. 1 to 3 a terminal fitting 10 is illustrated. The terminal 10 is comprised of two pieces, a first body piece 80 having an connection section at an end portion of the terminal 10 for being coupled to a conductor and also a contacting section for providing an electrical connection to a mating terminal pin (not shown); and a second covering piece 30 that encloses the contacting portion of the body 80 and further providing retention and reinforcement to the body 80 when the pieces are assembled together. Each piece is formed separately and secured together via a separate assembly or marriage die.

Figure 4:
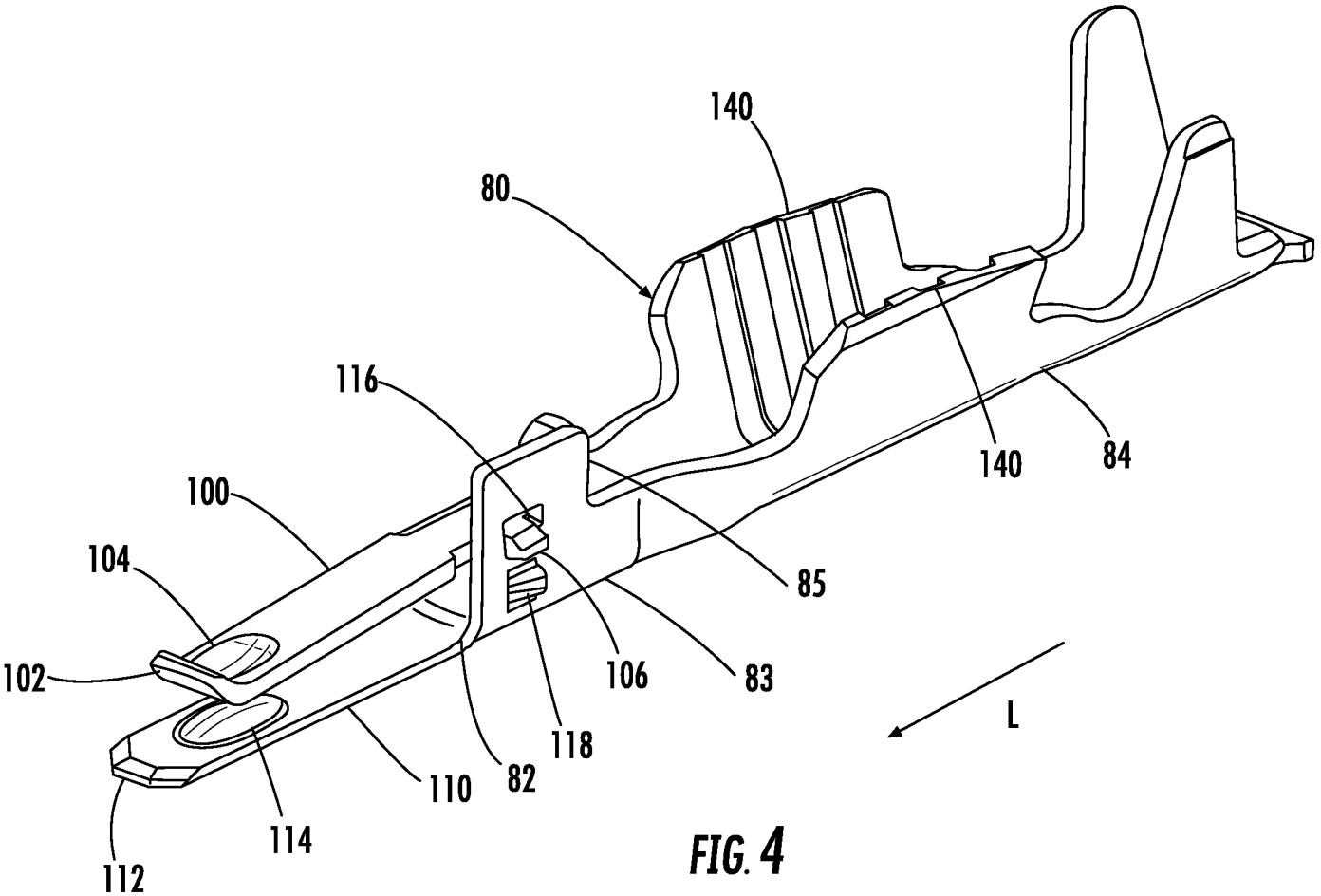
FIG. 4 is a perspective view of the body of the terminal of FIG. 1.
Figure 5:
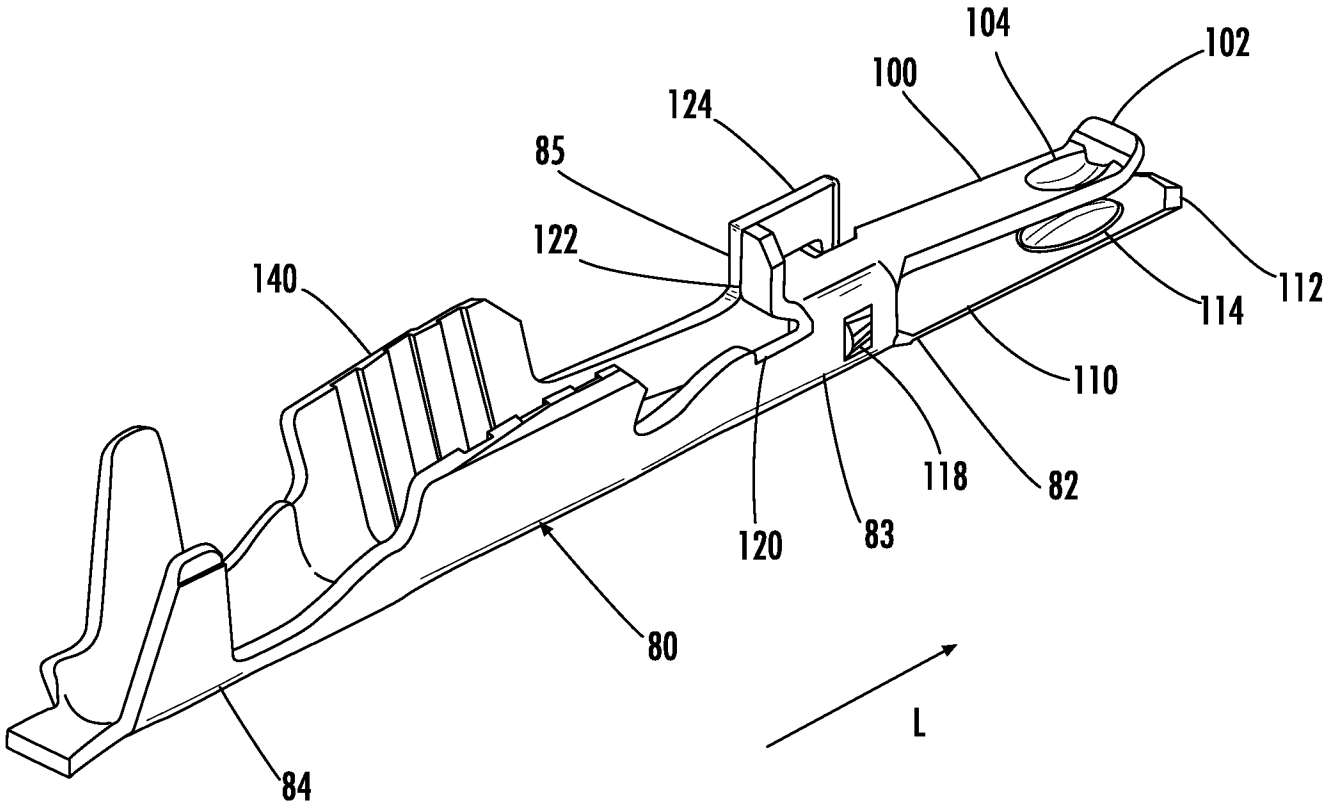
FIG. 5 is an alternate perspective of the body of FIG. 4.

As further illustrated in FIGS. 4 and 5 the body 80 is formed in a longitudinal insertion direction L and includes a termination or connecting portion 84 generally positioned at the rear or first end of the body 80 and a contacting portion 82 disposed at the front end or second end portion of the body 80. The first piece is stamped and formed from a single piece of an electrically conductive material such as copper or any other copper based alloy or similar material having the same electrical conducting properties. The termination portion 84 is "U" shaped and comprises and includes a first pair of wings 140 disposed adjacent the contacting portion 82 and a second pair of wing portions positioned adjacent the first pair of wing portions. The wings 140 are used to secure the bare conductor portion of a cable (not shown) and the second pair of wings is used to secure the insulation portion of the cable.

As previously described, the body is generally "U" shaped with a cantilevered flexible contact beam 100 and a stationary beam 110 formed at the contacting portion 82 of the body 80 for electrically engaging a mating terminal pin (not shown). The beams extend along the insertion axis and are formed from a base 83. The base portion 83 includes a bottom wall, a pair of opposing side walls and a top wall. The walls are formed by bending and include a tab 106 formed from the top wall and a slot 116 formed in a side wall with the tab 116 fitted into the slot 116 locking the base together. From the base portion 83 the stationary beam 110 extends forward along the insertion axis in a flat manner from the bottom wall and a flexible contact beam 100 extends form the top wall and oppose the stationary beam 110. The stationary beam 110 includes a chamfered front edge 112 and the flexible contact beam includes a bent guide portion 102 for ease of insertion of the mating terminal pin with both beams including a contact bump 104, 114 that engage the mating terminal pin upon connection.

Additionally, the side wall extends above the flexible contact beam 100 and includes a first stop edge 85 and a second stop edge 124. A flap 122 is formed from the wall and extends above the flexible contact beam 100 and is adjacent the first stop edge 85. The first stop edge 85 and the flap 122 defined a surface that is normal to the insertion axis L. As further depicted a louver 118 is formed on each of the side walls and extends radially outward from the insertion axis L.

The covering 30 shall now be described and illustrated by FIGS. 6 to 11. The covering 30 is stamped and formed from a flat plate and includes a periphery that is general rectangular. The periphery includes a bottom wall and a pair of side walls extending from the bottom walls and a top wall. In the embodiment the top wall includes a bent part that produces an angled portion of the top wall. The angled portion defines a unique peripheral contour that allows proper alignment and assembly when the terminals are inserted into the housing (not shown). The covering 30 includes a middle wall 26 that defines a lower section 22 and an upper section 24. The lower section 22 includes an opening 20 for receiving the terminal of the mating connector. Both the lower section 22 and the upper section 24 extend along the insertion axis L along the length of the covering 30.

Figure 6:
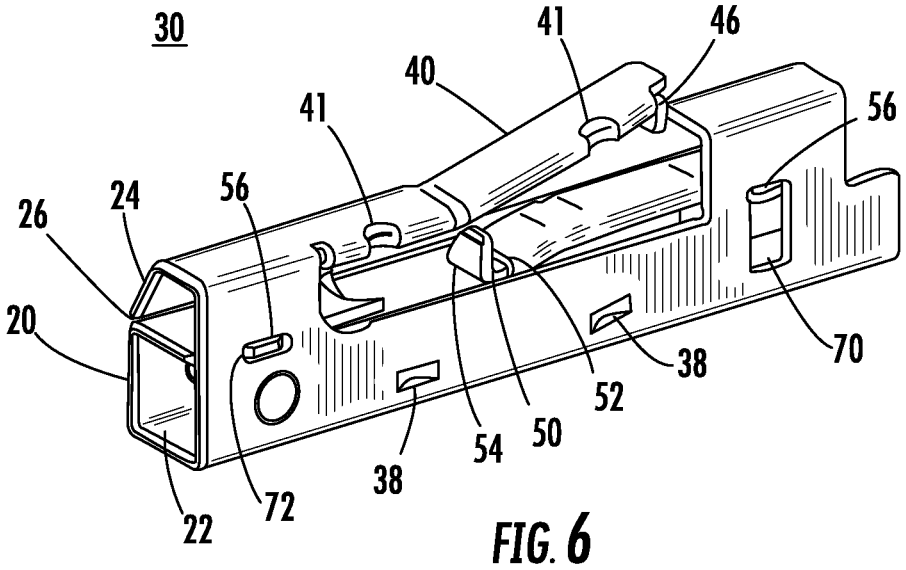
FIG. 6 is a perspective view of the covering of the terminal of FIG. 1.
Figure 8:
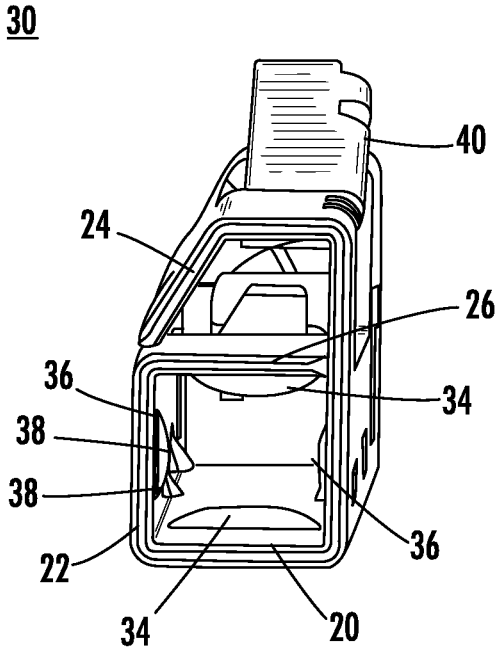
FIG. 8 is a detailed view of the covering of FIG. 6.
Figure 11:
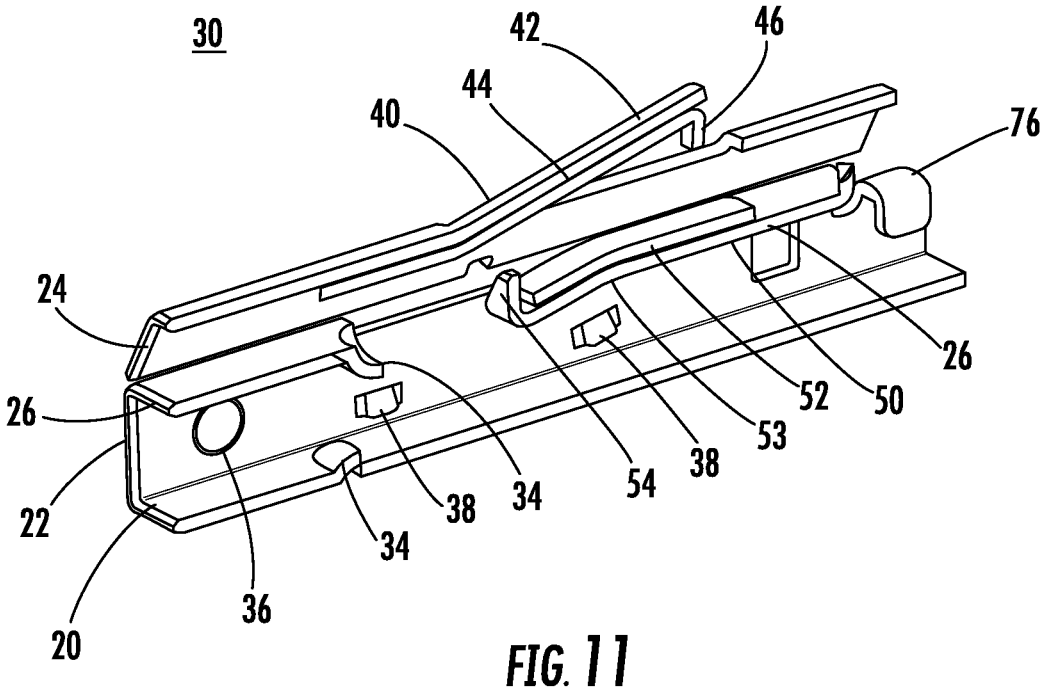
FIG. 11 is a sectional view of the covering of FIG. 6.
Figure 12:
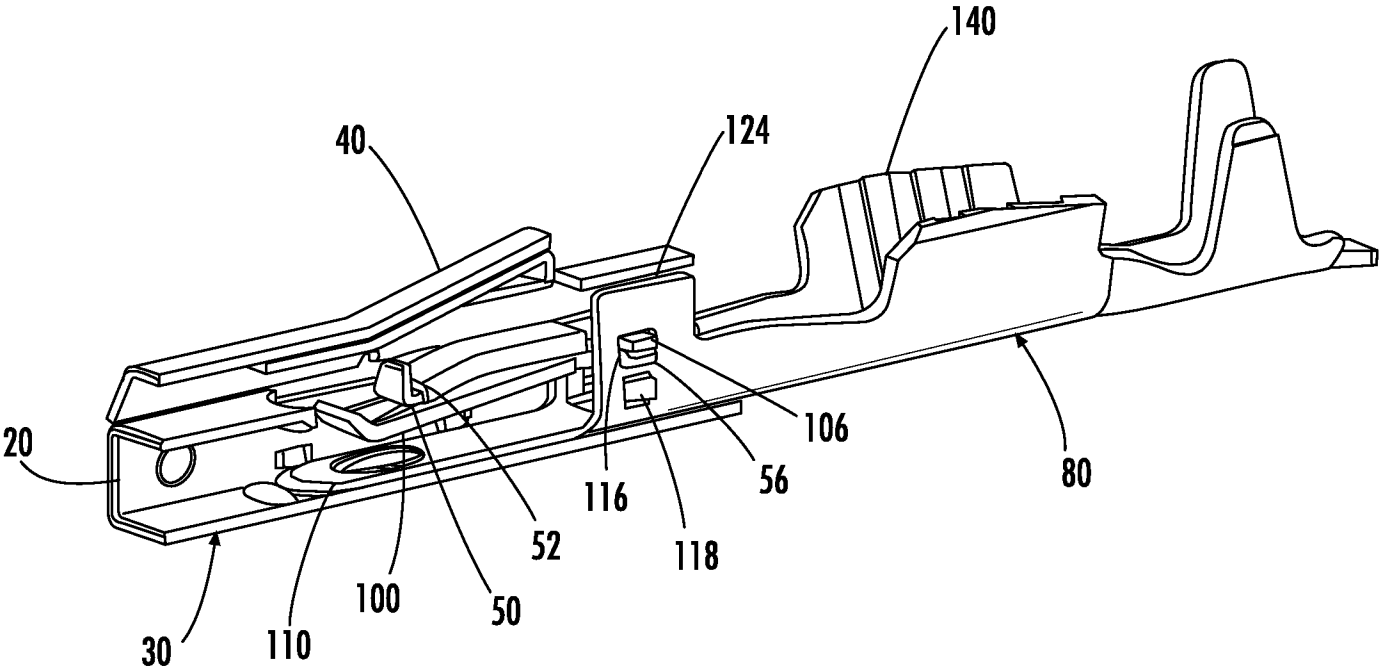
FIG. 12 is a partial sectional view of the terminal of FIG. 1.

As best shown in FIGS. 6 and 8, the covering 30 includes an opening 20 that is part of the lower section 22 for receiving a mating terminal. A pair of bumps 36 is formed in the side walls of the lower section 22 that protrude into the opening 20 and oppose each other. Similarly, a pair of opposing projections 34 is formed in the bottom wall and middle wall 26 and includes a round front portion and a rear flat portion as illustrated in FIG. 11. The projections 34 and the bumps 36 are used to align and center the mating terminal during the initial insertion of the prior to complete connection. Additionally, a plurality of support shoulders 38 are formed on the side walls and extend into the lower section 22 of the covering 30. As previously stated, the covering 30 is formed from a single piece of sheet metal, in the embodiment shown the material is stainless steel. In some instances steel provides additional benefits to copper or copper based alloys. Steel typically exhibits higher tensile strength properties and situations where it is used in spring or biasing applications is a superior choice when used when flexible members are required.

Figure 7:
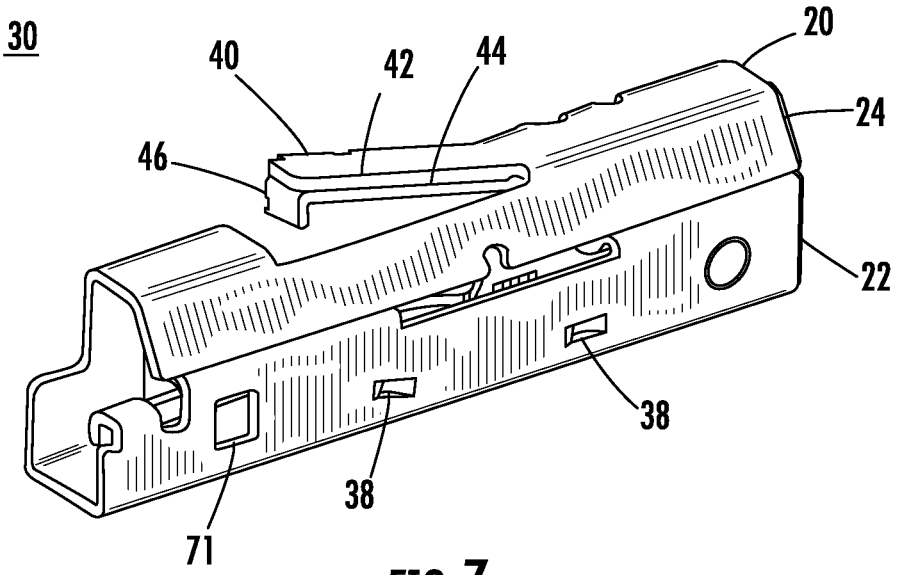
FIG. 7 is an alternative perspective of the covering of FIG. 6.
Figure 9:
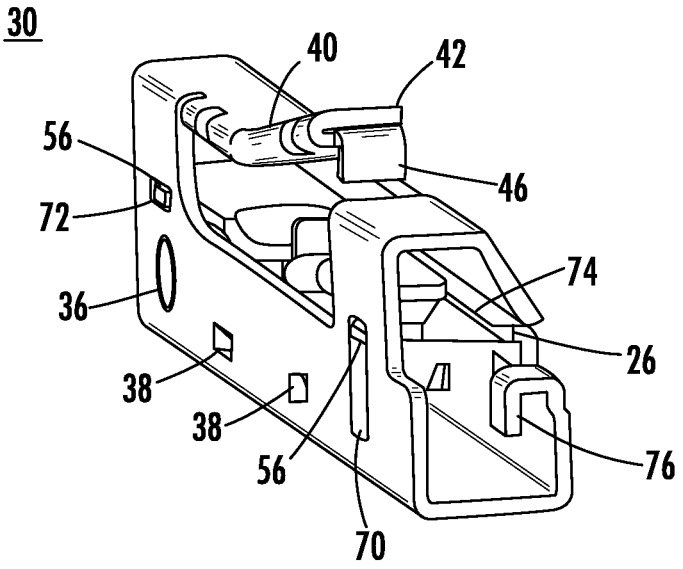
FIG. 9 is another detail view of the covering of FIG. 6.

As best shown in FIGS. 7, 9 and 11, a retention beam 40 is formed in the covering 30 and extends in an outwardly direction. The retention beam is bent and cantilevered from the top wall of the covering 30 and includes a first beam 42 and a second beam 44. The beams 42, 44 are disposed in a tandem relationship, that is, the beams are essentially stacked on each other creating a double thickness beam. A flap 46 is formed from the second beam 44 and projects downward and is sloped toward the opening 20 in the covering 30. Notches 41 are formed in the retention beam along the folded portion of the beam where the first beam 42 and the second beam 44 are joined.

Additional features and structures formed in the body 80 and covering 30 shall now be discussed in conjunction with the assembly of the covering 30 to the body that completes the terminal 10. With reference to FIGS. 12 to 15, the body 80 is inserted into the rear of lower section 22 of the covering 30 opposite the opening 20 with the stationary beam 110 positioned on the bottom wall of the covering 30. The stationary beam 110 is slid forward toward the opening 20 with the stationary beam disposed between the bottom wall and the support shoulders 38 formed on the side walls of the covering 30. The body 80 is slid forward until the front edge 112 engages the rear flat portion of the projection 34 in the bottom wall. At this time, it should be understood that the covering 30 is not fully formed, but requires further operations to complete the assembly. The covering 30 is shown in its final fully formed state for simplicity and clarity.

Figure 10:
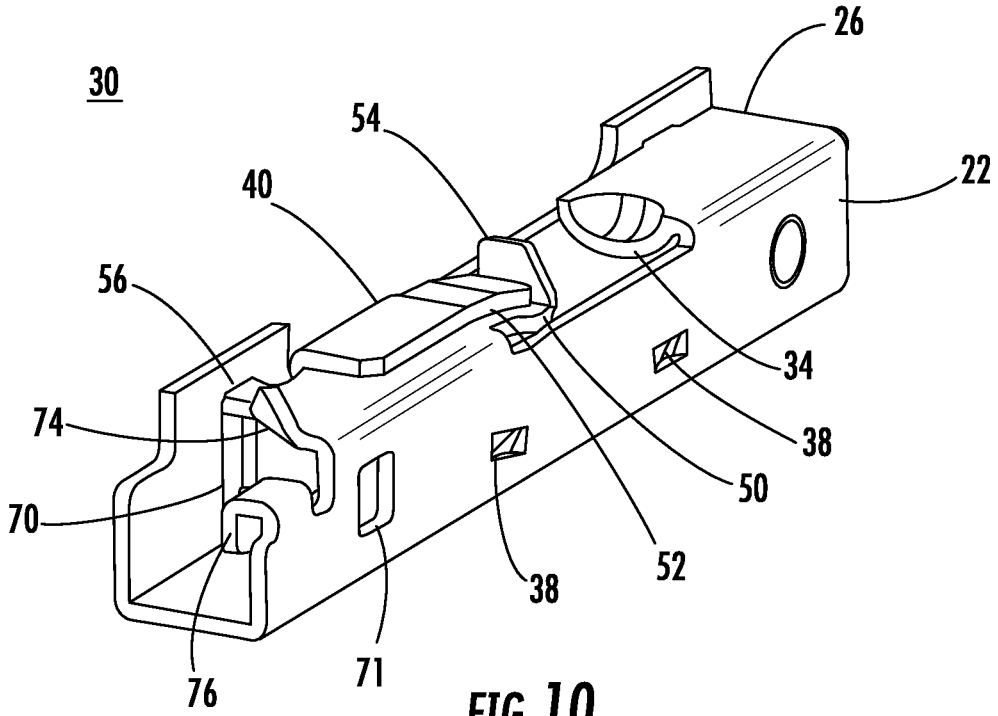
FIG. 10 is a detail view of the covering of FIG. 6 with the top portion removed.
Figure 13:
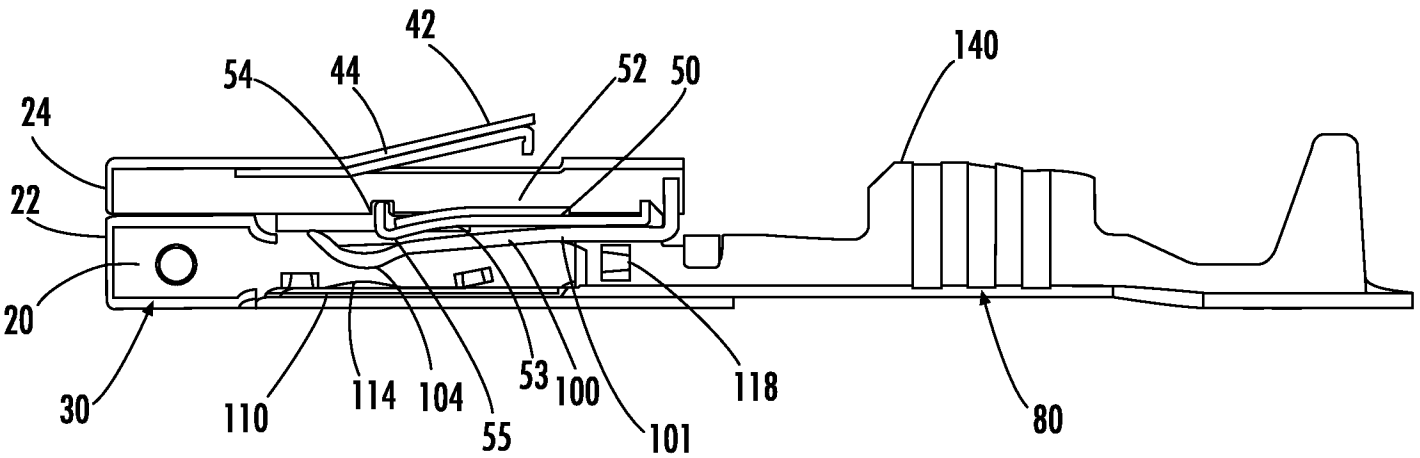
FIG. 13 is a sectional view of the terminal of FIG. 1.
Figure 14:
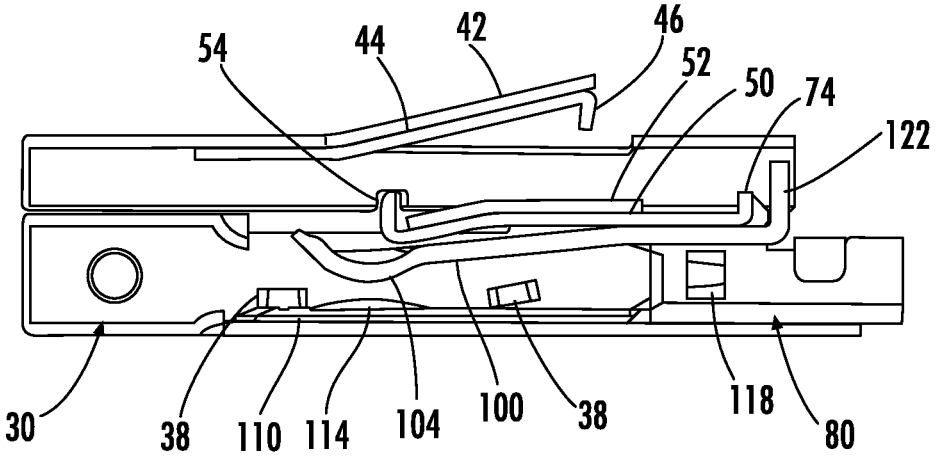
FIG. 14 is a detail view of the covering of FIG. 11.

During the insertion of the body 80 into the covering 30, as previously stated, the stationary beam properly aligned in the lower section 22, the flexible contact beam 100 is inserted into the lower section 22 as best illustrated in FIGS. 10 and 13, please note that securing strap 76 is not bent at this time, and guided by bent portion 74. Upon further insertion, the bent guide portion 102 is directed by bent portion 74 under stiffening beam 50 and support beam 52. Stiffening beam 50 and support beam 52 are formed form the middle wall 26 of the covering 30 and extend into the lower section 22.

As best shown in FIG. 13 the cross section illustrates the layout of the beams. As previously described, the flexible contact beam is formed in the body and is cantilevered from a first point 101 located on the base 83 of the body 80. The stiffening beam 50 is formed from the middle wall 26 of the covering 30 and is cantilevered from a second point 53, that is, the point where stiffening beam 50 is bent downward into the lower section 22 form the middle wall 26. A third point 55 is located where the stiffening beam 50 engages the flexible contact beam 100. In this arrangement, the flexible contact beam 100 is additionally support by the stiffening beam 50 and the support beam 52. This provides increased resistance to deflection during mating and increases the normal force providing superior electrical connection. By the usage of higher tensile strength material in the covering 30, the normal force can be further increased.

As further illustrated an overstress protection tab 54 is bent upward from the stiffening beam 50 and in operation prevents the beams for being overly bent to the point of premature deformation. In operation, during mating, a terminal pin is inserted into the opening 20 and is located between the stationary beam 110 and the flexible contact beam 100 and deflects the flexible contact beam 100, the stiffening beam 50 and the support beam 52 upward. If the beams are overly deflected, the overstress protection tab 54 will engage the lower surface of the second beam 44 of the retention beam 40 thereby limiting the total amount of deflection of the beams.

Figure 18:
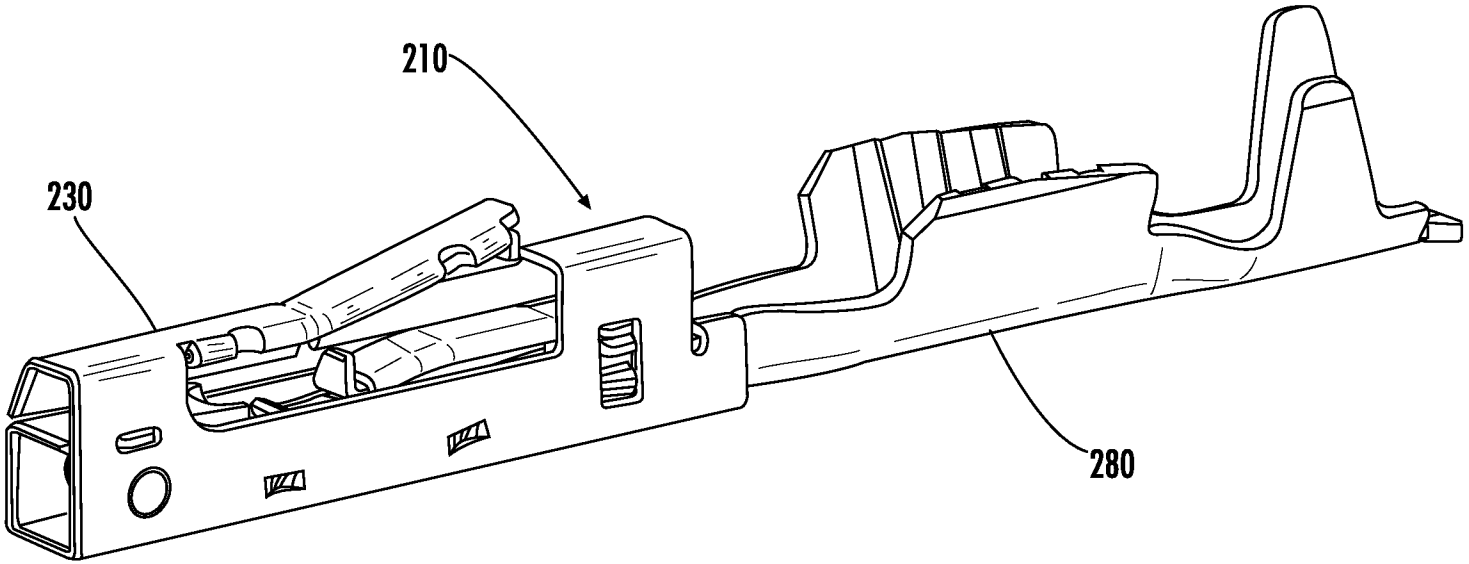
FIG. 18 is a perspective of and alternative embodiment of the terminal.
Figure 19:
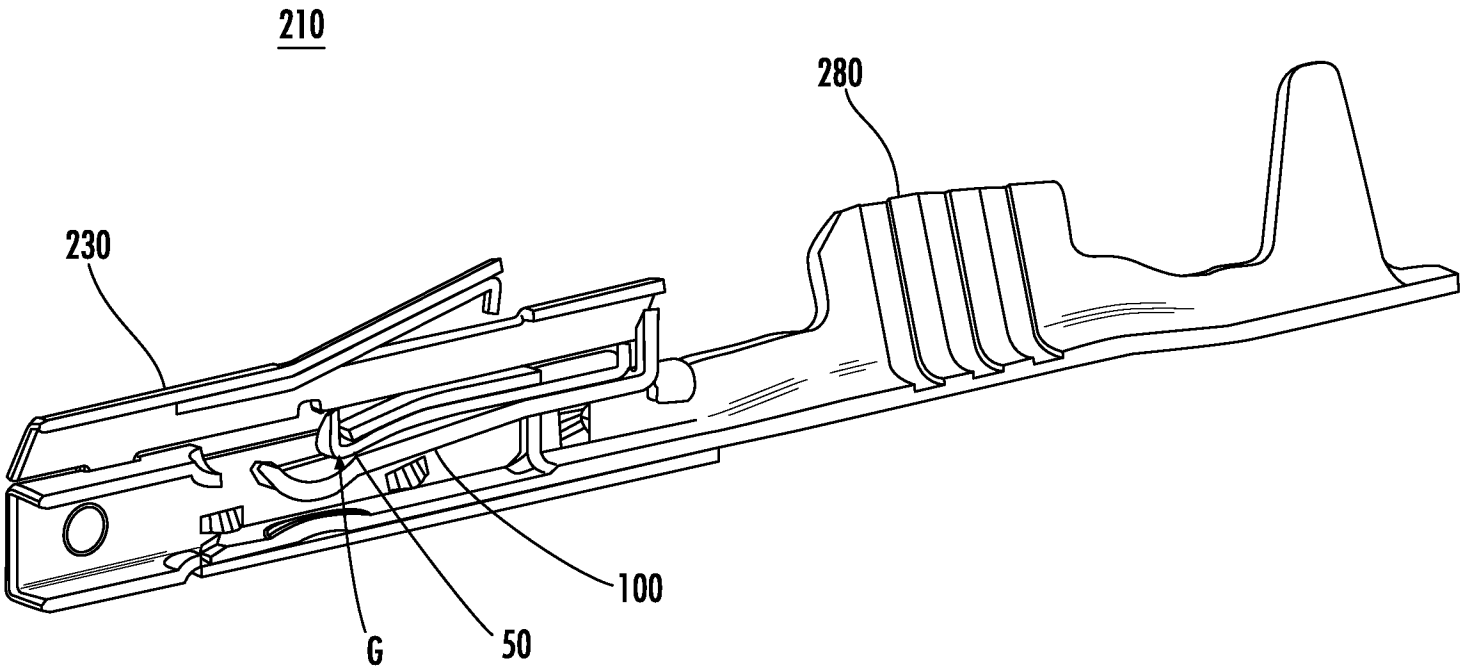
FIG. 19 is a sectional view of the terminal of FIG. 18.
Figure 20:
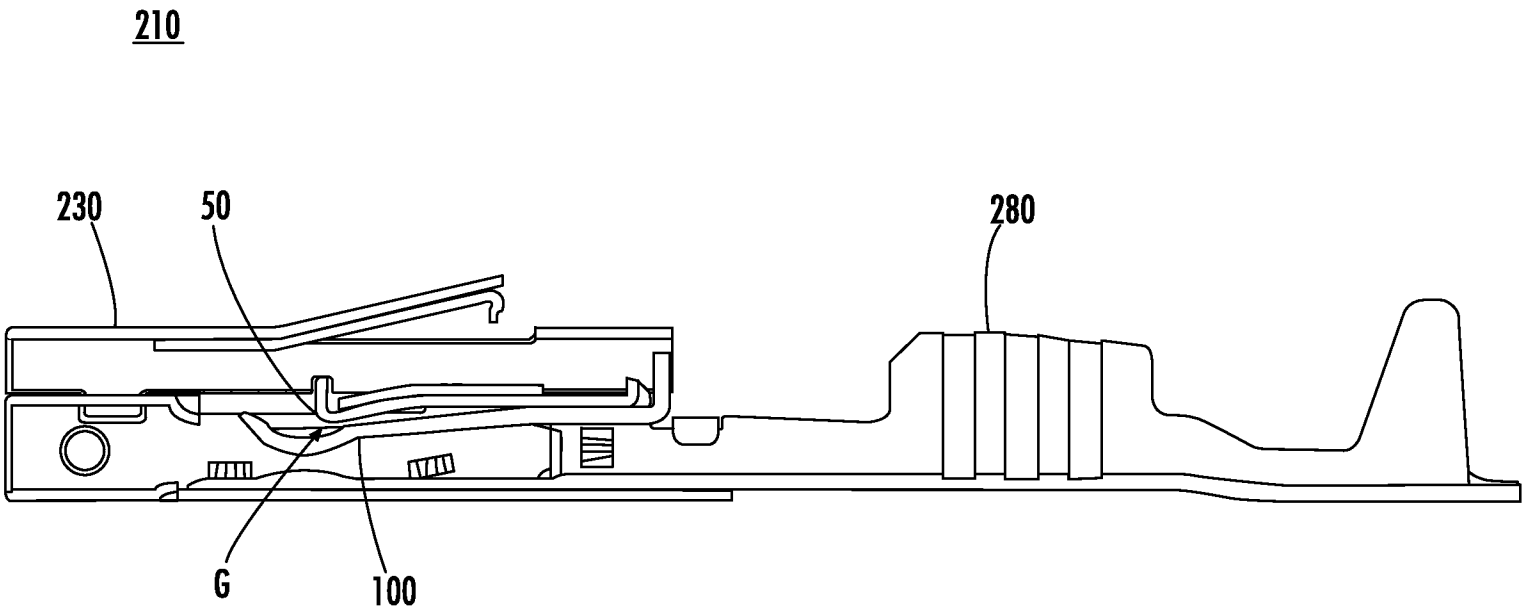
FIG. 20 is an alternative sectional view of the terminal of FIG. 18.

An alternative embodiment is illustrated in FIGS. 18-20 in which a terminal 210 is similarly constructed from a body 280 and a covering 230 secured to the body 280. In the previous embodiment, the stiffening beam 50 is in direct contact with the flexible contact beam 100 in the unmated condition at a third point 55. In this circumstance, the stiffening beam 50 provides instant resistance and increased normal force upon initial displacement of the flexible contact beam 100 during mating. In certain instances an initial high normal force or insertion force can cause damage to the electrical interface between the flexible contact beam 100 and the mating male electrical pin (not shown) such as ploughing which results in high electrical resistance at the interface. In certain instances in is beneficial to reduce the insertion force during mating to minimize potential damage.

As best shown in FIG. 19, the stiffening beam 50 is spaced apart from the flexible contact beam 100 by a gap G at the third point 55. In this case during mating, the flexible contact beam 100 is deflected upon initial contact by the mating pin (not shown). The initial reaction force or normal force is produced only by the flexible contact beam 100 and not by the combination of the flexible contact beam 100 and the stiffening beam 50. As a result, this force is lower than that of the previous embodiment. Upon further deflection of the flexible contact beam 100, a contacting point on the stiffening beam 50 is subsequently engaged and then both beams contribute to the force buildup. In this embodiment, both the flexible contact beam 100 and the stiffening beam 50 contribute to the normal force during the sliding contact portion of the mating cycle, thus the initial insertion force is reduced.

Figure 21:
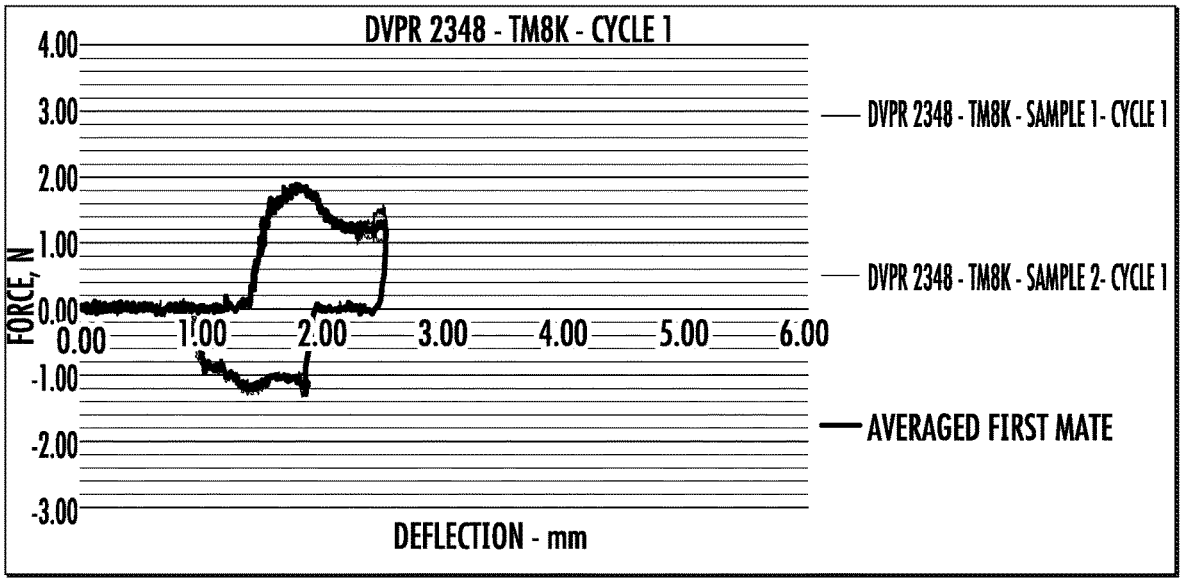
FIG. 21 is a force distribution table.
Figure 22:
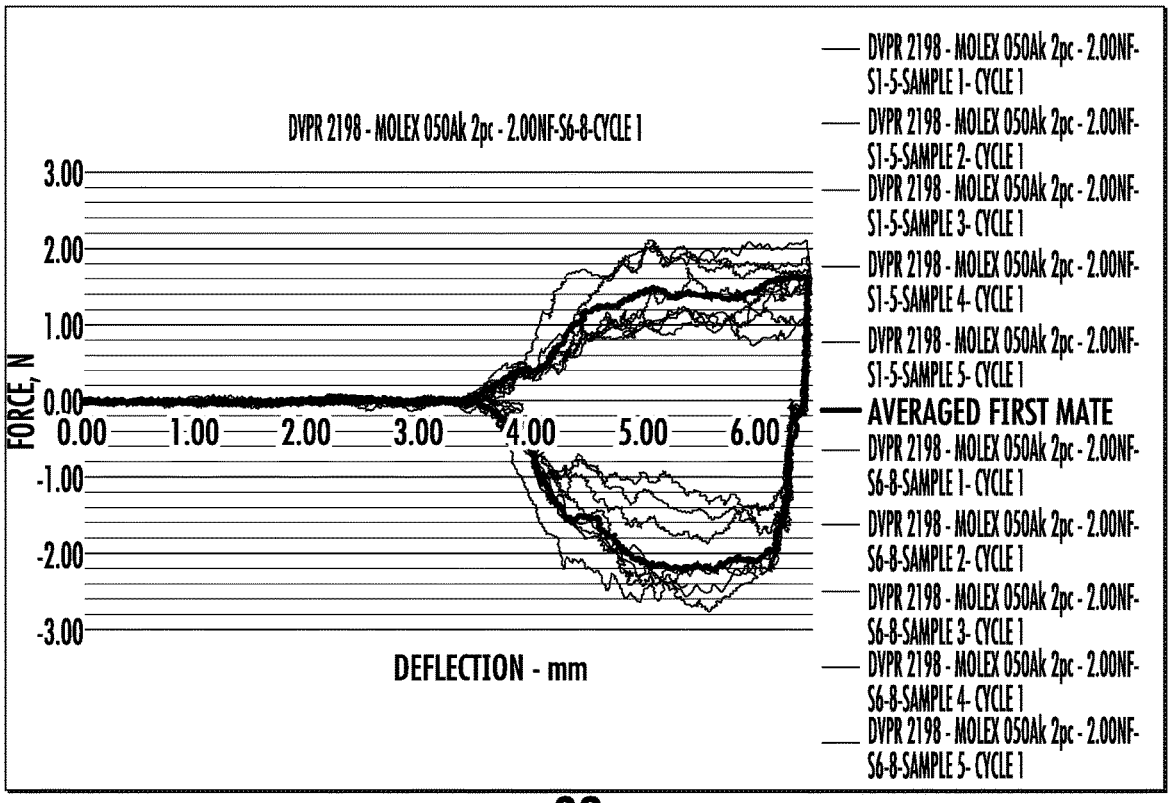
FIG. 22 is a force distribution table.
Figure 23:
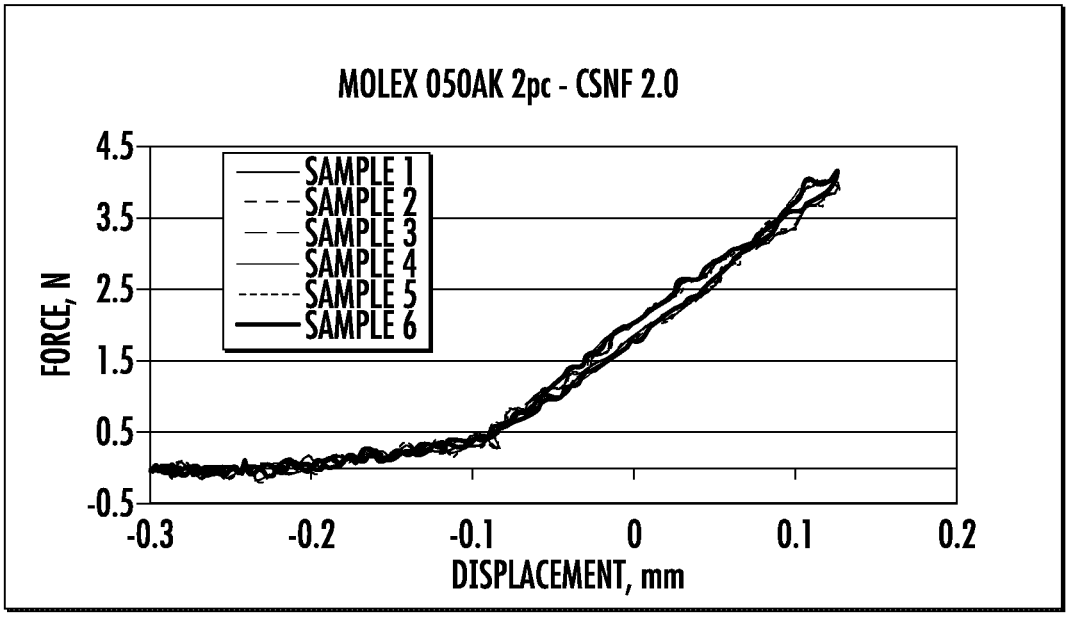
FIG. 23 is a forces versus displacement plot.

The force distribution is illustrated in FIGS. 21-23 in which FIG. 21 shows a typical mating force distribution during a complete mating cycle for a single beam type of terminal system while FIGS. 22-23 shown the force distribution for the embodiment depicted in FIGS. 18-20. From initial insertion force or force spike shown in FIG. 21 is significantly reduced.

As illustrated in FIGS. 9 and 12 to 15 the final stages of the assembly will now be described. As previously described the body 80 is inserted into the covering 30 and once in its proper location, the covering 30 requires additional forming to secure the body 80 and covering 30 together. There are several features and steps involved during this process. Louvers 118 formed on the body are inserted in to slots 70, 71 formed in the covering 30 and secures the body to the covering 30 along the insertion axis L. Securing tabs 56 formed on the middle wall 26 are inserted into slots 70 and 72 and hold the middle wall in place. These securing tabs 56 essentially prevent the middle wall 26 from "unfolding" and maintain the lower section 22 and upper section 24.

Figure 15:
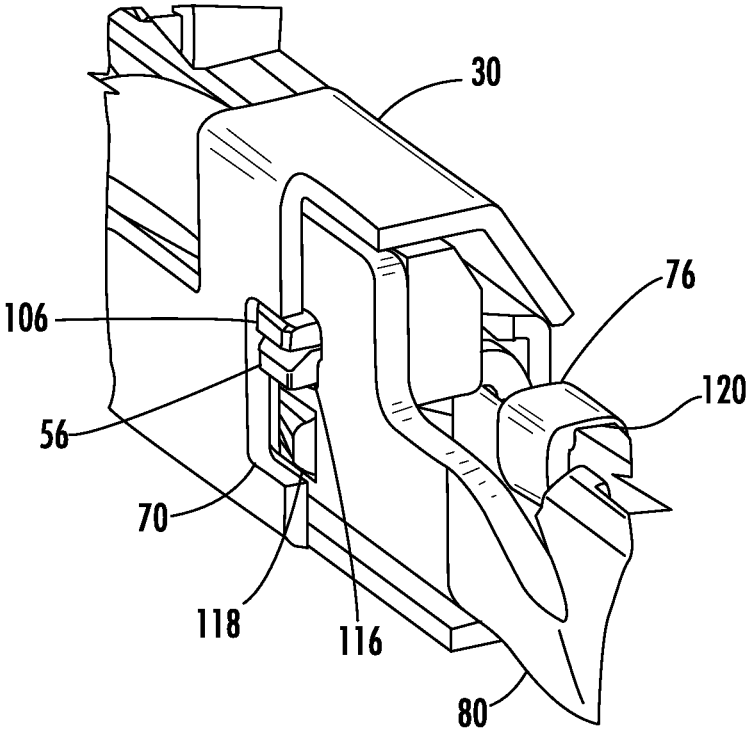
FIG. 15 is a partial sectional view of the terminal of FIG. 1 showing the joining potion of the covering and the body.

The final operation is best illustrated in FIG. 15. In this step the securing strap 76 formed on the covering 30 is bent over the body 80 and is disposed in a securing recess 120 formed in the body 80. At this time, the top portion of the peripheral contour is formed over the top portion of the middle wall 26 closing the covering 30 and completing the peripheral contour. Additionally, the second stop edge 124 formed on the body 80 engages the inner surface of the top wall of the covering 30 to prevent over-forming of the top wall during this step. As this time, the tab 106 is inserted thorough the slot 116 in the body 80 and securing tab 56 which has already be inserted in slot 116 of the body are both inserted into the slot 70 of the covering 30. In other words the body 80 includes a first tab 56 and a first slot 116 and the covering 30 includes a second tab 106 and a second slot 116 with the tabs 56, 116 extending through the slots 70, 116 when the covering 30 is joined to the body.

The connection portion 84 is configured to receive an electrical lead wire, having an insulative covering 30 that provides a protective barrier against shorting between adjacent wires. The front portion of the wire (not shown) has a portion of the insulation removed to expose the conductor whereby the bare conductor is placed within the first pair of wings 140 and a portion of the unstripped wire is received in the second pair of wing portions 144. Each set of wing portions are then formed over the respective portions of the wire to secure the wire to the terminal. The first pair of wing 140 secures or crimps the terminal to the bare wire portion of the lead wire and the second pair of wings 144 secures or crimps the insulating portion of the lead wire to the terminal fitting.

Figure 16:
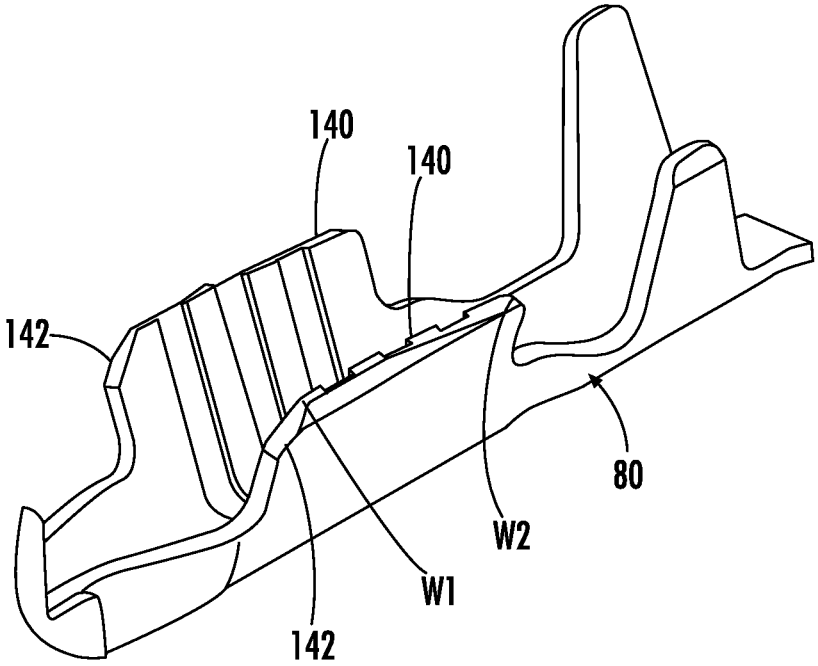
FIG. 16 is a perspective of the wings of the terminal of FIG. 1.
Figure 17:
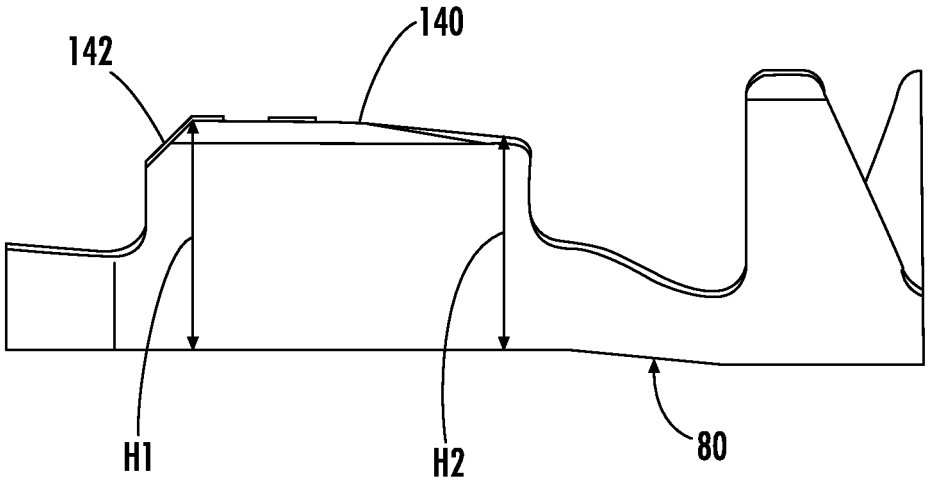
FIG. 17 is a side view of the wings of FIG. 14.

As best shown in FIGS. 16 and 17, the first pair of wings 140 secures the bare wire portion of the lead wire to the terminal 10 and includes a coined edge. The edge as referenced from the bottom surface of the terminal 10 has a greater extension or height H1 toward the front of the terminal 10 than the height H2 at the rear end of the terminal 10. The front portion of the wings 140 also includes a bevel 142. Additionally, the coined edge also includes a variation in width. As best shown in FIG. 16, the front end of the coined edge of the wing 140 has a width W1 that is less that the width W2 at the rear portion of the wing 140. This shape is mirrored to the other wing portion of the front pair.

Due to this configuration, upon crimping or the securing of the wire to the terminal 10, the wings 140 provide a varying degree of deformation and crimp pressure. That is, after the wire is secured to the terminal 10, the crimp force varies along the length of the wing 140. In operation, the conductor is typically a stranded wire with free ends and the front portion of wings 140 has to be deformed or crimped more than the rear portions of the front pair of wings.

An advantage to this is that the tip portion of the wire is compressed more at the very front of the wire and decreases as the crimp section moves rearward. This avoids excessive deformation and damage to the front of the stranded wire thereby minimizing resistance. Due to the fact that there is less deformation at the rearward portion of the wire crimp portion any damage to the wire due to over compression is removed, thereby resulting in greater mechanical holding and increased electrical performance and conductivity along the wing 140 and between the wire and the terminal 10.

In operation, the terminal 10 or terminals are inserted into a housing (not shown) within corresponding cavities that are formed in the housing. The cavity is shaped to the terminal peripheral contour so that in can be inserted without misalignment. As previously described, the terminal includes a retention beam 40 formed in the upper section 24 of the covering 30. The cavity includes a corresponding shoulder that engages the retention beam 40 in a direction opposite to which the terminal is inserted into the cavity, that is, this arrangement prevents the withdrawal of the terminal 10 from the cavity. In the embodiment shown the cross-section of the retention beam 40 is a folded over wall creating a double-walled retention beam, but other cross-sections can be employed, for instance an "L" shaped cross-section or any cross section that provides an increased resistance to bending. In this case, the folded cross-section adds stiffness to the beam to prevent it from buckling under load.

A flap 46 is formed at the free end of the retention beam 40 and the flap 46 is formed in a direction toward the covering 30 that provides a measure of protection so that wires or the like cannot catch or snag on the retention beam and damage it prior to assembly. The flap 46 also provides a surface for the retention beam to engage when inserted into the connector housing cavity. The flap 46 abuts a shoulder or recess formed in the cavity so that the electrical fitting resists pull out after being completely inserted within the housing. The flap 46 is bent toward the opening of the terminal 10 providing a tendency for the retention arm to be deflected outwardly upon attempted withdrawal. In effect causing the retention arm to engage the cavity more abruptly and resisting terminal pullout. The flap 46 also provides a larger area for engagement with the cavity so that damage to the housing material is avoided.

Once all of the terminals 10 are inserted into the housing and fully seated in each respective cavity, an independent secondary lock, ISL is typically employed to further retain the terminal 10 within the housing. The ISL is generally attached to the side of the housing in a first position that allows the terminals to be inserted into the cavities. Once the terminals 10 are inserted, the ISL is actuated or slid to a second position providing an addition lock for the terminals 10. In the embodiment shown, specifically as in FIG. 15, a stop edge 85 and stop flap 122 abut a shoulder formed in the ISL that is slid into engagement when the ISL is moved to the second position providing further prevention of terminal 10 withdrawal.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of contact array connectors. Also, there are many possible variations in the materials and configurations.

We claim:

1. A terminal comprising:

a body, the body having a longitudinal insertion axis and having a connection section along an end portion of the terminal and a contacting section extending away from the connection section, the connection section having a flexible contact beam and a stationary beam, the flexible contact beam cantilevered from a first point, the stationary beam opposes the flexible contact beam and the wire securing portion having a wing; and a covering, the covering having a peripheral contour, the peripheral contour is divided by a middle wall, the middle wall defining an upper section and a lower section, the upper section including a locking arm that extends toward the connection section, the lower section including a stiffening beam, the stiffening beam formed from the middle wall and cantilevered from a second point and includes a contacting point, the contacting point of the stiffening beam is spaced apart from the flexible contact beam at a third point, the second point is disposed between the first point and the third point, wherein the body is supported by the lower section.

2. The terminal of claim 1, wherein a support beam engages the stiffening beam.

3. The terminal of claim 2, wherein the support beam is formed from the middle wall.

4. The terminal of claim 1, wherein a first securing tab is formed on the body and a second securing tab is formed on the covering and the tabs are disposed in a slot formed in the body.

5. The terminal of claim 4, wherein the tabs extend through the slot in the in the body and are disposed in a second slot formed in the covering.

6. The terminal of claim 1, wherein the wing includes a coined edge having a first portion and a second portion.

7. The terminal of claim 6, wherein the first portion includes a bevel.

8. The terminal of claim 7, wherein the first portion has a first height and the second portion has a second height and the first height is greater than the second height.

9. The terminal of claim 8, wherein the first portion has a first thickness and the second portion has a second thickness and the first thickness is less than the second thickness.

10. A terminal comprising:

a body with a stationary beam and a flexible beam, the stationary beam and the flexible beam opposing each other; and;

a separate covering, the covering configured to be secured to the body, the covering having a stiffening beam that supports the flexible beam and wherein the stiffening beam is spaced apart from the flexible beam.

11. The terminal of claim 10, wherein the body is made from a first material and the covering is made from a second material.

12. The terminal of claim 11, wherein the second material is a high tensile strength material.

13. The terminal of claim 12, wherein the second material is steel.

14. The connector of claim 10, wherein a support beam is formed from the covering and engages the stiffening beam.

15. A connector comprising;

a housing, the housing formed from an insulative material, the housing including a cavity, the cavity including a shoulder; and a terminal, the terminal having a body and a covering, the body including a flexible beam and a stationary beam, a covering, the covering including an upper section and a lower section, the covering including a locking arm extending from the upper section that engages the shoulder and a stiffening beam extending into the lower section that supports the flexible beam, wherein the covering is joined to the body by forming the covering over the body after the body is inserted into the lower section.

16. The connector of claim 15, wherein a support beam is formed in the cover and engages the stiffening beam.

* * * * *